US005471821A

United States Patent [19]

Lindgren

[11] Patent Number: 5,471,821

[45] Date of Patent: Dec. 5, 1995

[54] APPARATUS FOR FILLING AND SEALING LIQUID-PHASED EXTRUDED CONTAINERS AND METHOD

[76] Inventor: Peter B. Lindgren, 4491 Crystal Lake Dr., Apt. 205A, Pompano Beach, Fla. 33064

[21] Appl. No.: 300,466

[22] Filed: Sep. 2, 1994

[51] Int. Cl.[6] ..... B65B 43/00; B65B 61/24

[52] U.S. Cl. ..... 53/452; 53/440; 53/561

[58] Field of Search ..... 53/452, 453, 440, 53/450, 561, 559, 558

[56] References Cited

U.S. PATENT DOCUMENTS

| | | | |
|---|---|---|---|
| 2,896,250 | 7/1959 | Craig | 53/561 |
| 3,336,425 | 8/1967 | Valyi | 53/561 X |
| 3,357,046 | 12/1967 | Pechthold | 53/561 X |
| 3,827,214 | 8/1974 | Naumann | 53/561 |
| 4,342,184 | 8/1982 | Van Eck et al. | 53/561 X |
| 4,620,410 | 11/1986 | Chiodo et al. | 53/561 |

*Primary Examiner*—James F. Coan

[57] ABSTRACT

An apparatus and method for filling liquid-phased extruded containers comprises injecting the extruded material into a die head forming a tubular shape. The die head is hollow, or bored, from its back end to its front where the extruded material egresses to form the extrudate (pre-container) tube shape. A means for introducing a separable insert through the die head bore permits the insert to be encased within the tube while the thermoplastic material is still in its liquid or molten phase. Pinch rollers seal the tube at ends opposite that of the insert while avoiding the insert, while the line of sealed containers is pulled by gear rollers through a water cooling bath. A die punch stamp cuts the pinched, or sealed, sections of the containers separating them into individual, filled, singular units.

10 Claims, 4 Drawing Sheets

APPARATUS FOR FILLING AND SEALING LIQUID-PHASED EXTRUDED CONTAINERS AND METHOD

FIELD OF THE INVENTION

The present invention relates to an apparatus and method for filling extruded, hollow containers. More particularly, the present invention comprises a novel apparatus for filling extruded, hollow containers made of a thermoplastic material, while in the liquid or molten stage, with inserts of appropriate size corresponding to the said containers.

BACKGROUND OF THE INVENTION

Heretofore, the convention of manufacturing filled, molded containers has been achieved by molding such containers through direct mold injection or the injection of gas pressure within a mold cavity. An injection of hot plastic material is generally extruded between the open mold, or halves of a mold. The mold is then closed, pinched off, and a blow needle inserted to introduce a filling medium, such as air, to inflate the container to the predetermined mold cavity specification. The blow needle is then removed, the mold opened, and the inflated container removed.

The filling of these types of containers are accomplished in a number of ways at the discretion of the user. They are conventional and well known. These methods all have one thing in common—they introduce the to-be-filled filled material after the thermoplastic container has cooled and is in a solid state. There is no known apparatus and/or method for filling a thermoplastic container with a separable insert while the container is in the liquid or molten phase thus increasing efficiency in ensuring a completely sterile environment during the fill stage.

SUMMARY OF THE INVENTION

It is an object of the present invention to provide an apparatus and method for manufacturing thermoplastic containers and filling the said containers while the thermoplastic material is in its liquid or molten phase.

It is another object of the present invention to provide for an apparatus and method of producing, in a line, a continuous plurality of containers that may be filled while the thermosplastic container is still in a liquid or molten phase. The containers can be automatically sealed in line, cooled and separated from each other. The resultant product comprises a continuous single line that is automated and capable of producing a large number of completed, separate, filled containers.

It is still another object of the present invention to produce a container that can be filled in a heat-sterile environment.

It is yet another object of the present invention to provide an apparatus and method for producing filled, thermoplastic containers that require no mold or inflation means to form the container.

It is still another object of the present invention to provide an apparatus for introducing separable, discontinous inserts as the fill medium into the container while the container is in its liquid or molten phase.

It is yet still another object of the present invention to provide an apparatus that can produce a continuous string of connected containers.

The preferred emodiment of the present invention comprises an apparatus for making hollow plastic containers from a tube of extruded material. The extruded material is injected into a die head forming a tubular shape. The die head is hollow, or bored, from its back end to its front where the extruded material egresses to form the extrudate (pre-container) tube shape. A means for introducing a separable insert through the die head bore permits the insert to be encased within the tube while the thermoplastic material is still in its liquid or molten phase. Pinch rollers seal the tube at ends opposite that of the insert while avoiding the insert, while the line of sealed containers is pulled by rollers through a water cooling bath. A die punch stamp cuts the pinched, or sealed, sections of the containers separating them into individual, filled, singular units.

The above and further objects and novel features of the present invention will more fully appear from the following detailed description when the same is read in connection with the accompanying drawings. It is to be expressly understood, however, that the drawings are for the purpose of illustration only and are not intended as a definition of the limits of the invention, reference for the latter purpose being had primarily to the appended claims.

IN THE DRAWINGS

For a better understanding of the invention and to show how the same may be carried into effect, reference will now be made by way of example to the accompanying drawings, in which.

DETAILED DESCRIPTION OF A PREFERRED EMBODIMENT

Figure 1:
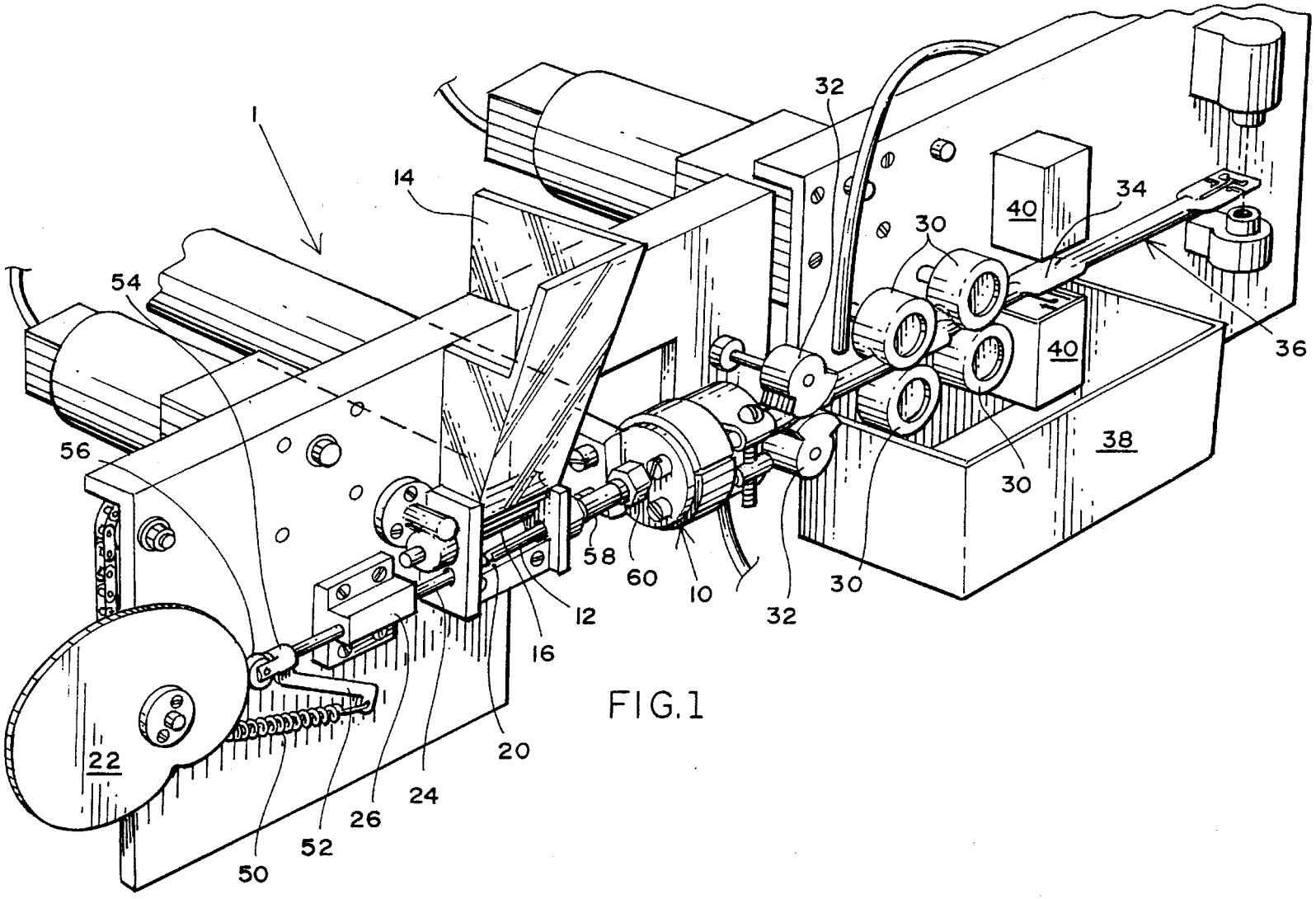
FIG. 1 is a perspective view of the present invention.

Referring to the drawings, that which is shown is an example of how the present invention may be used. In this application, chemical lighsticks are being manufactured by introducing glass ampules (inserts) containing separated chemicals when, admixed, result in a chemiluminescence, into plastic hollow tubes which are sealed and cut along the sealed portion thereof. Any insert may be used in the present invention by simply modifying the loading and introduction means to accommodate for the size of the insert as hereinbelow described.

Figure 3:
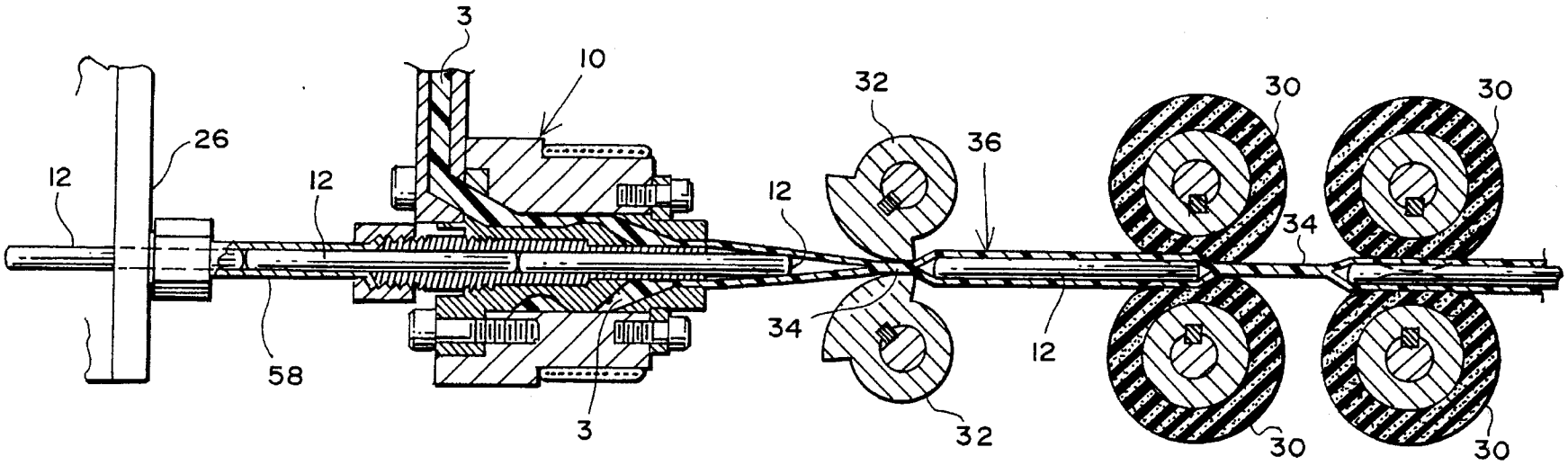
FIG. 3 is a partial cross sectional side view of the present invention highlighting insert encasement.
Figure 3:
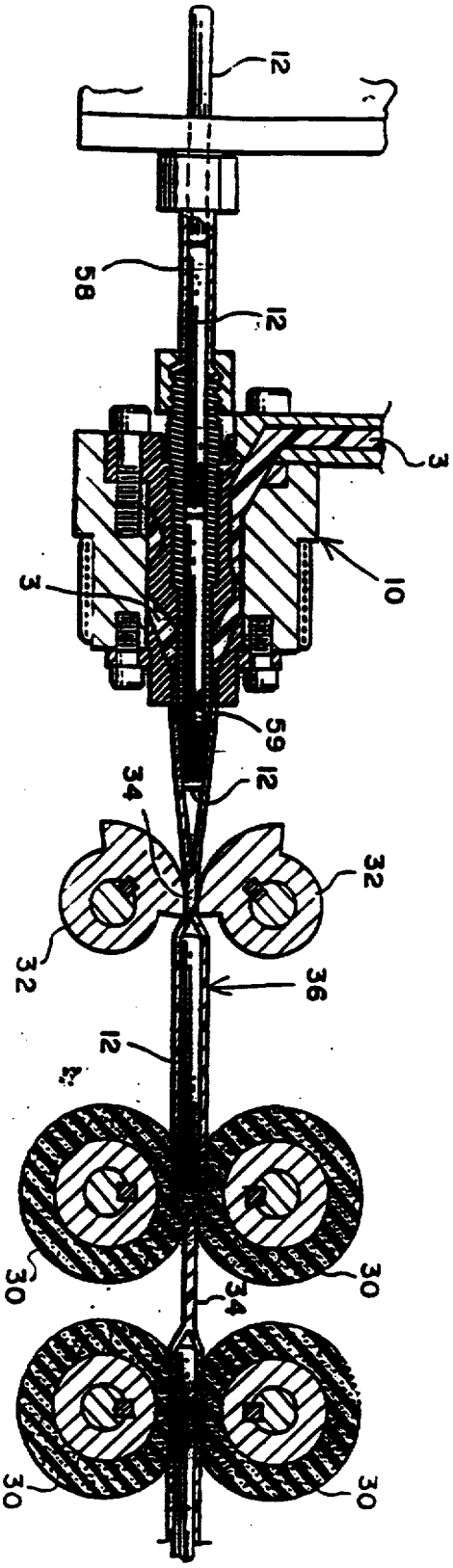
Figure 2E:
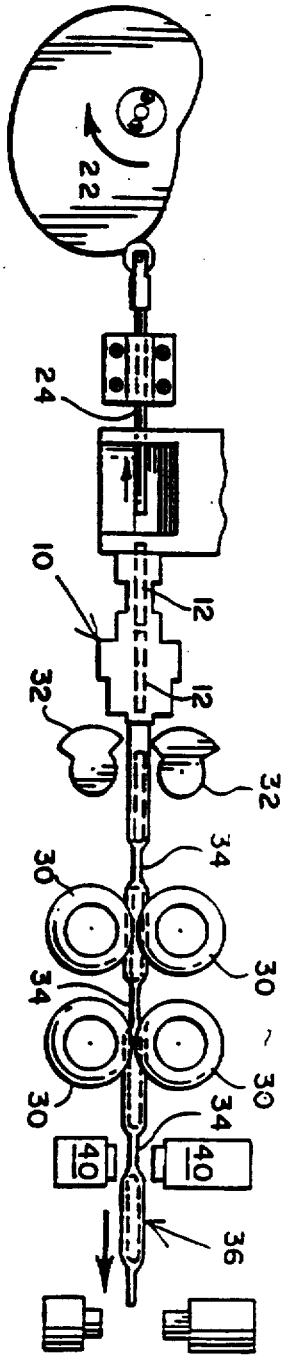

Referring to FIG. 1, appartaus 1 comprises a standard extruder (diagrammatically shown) feeds its molten compound 3 into a die head 10 (See Also FIG. 3). The molten compound 3, a thermoplastic material, is extruded through the die head 10. The extruded material at this stage is also known as extrudate, and the extrudate has a shape defined by the die head 10, as, in the drawings, a tubular or hollow shape.

Figure 4:
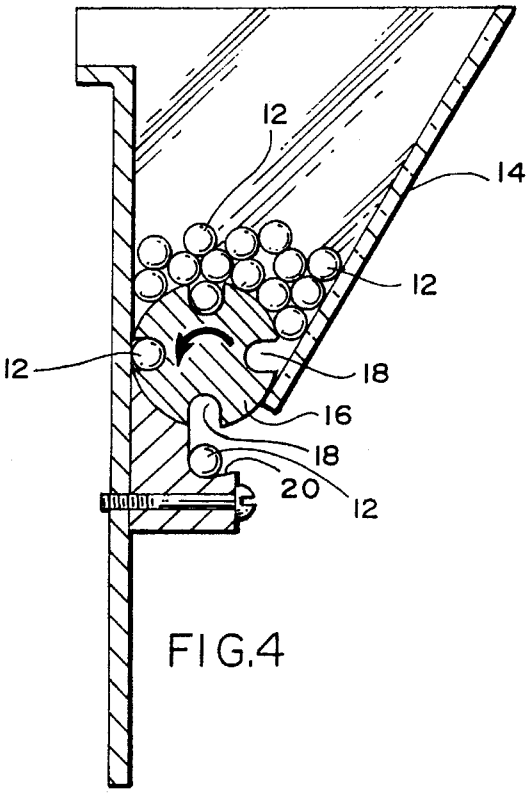
FIG. 4 is a cross section side view of the insert loading means of the present invention.

In advance of the extrusion process, a separable insert 12 is introduced to the apparatus 1. A plurality of inserts 12 are placed into a loader 14, as best seen in FIG. 4. The inserts 12 come to rest at the bottom of the loader 14 where a feeder wheel 16 is located. Feeder wheel 16 is gear driven and rotates about its axis. Through gravity and the rotation of feeder wheel 16, an insert 12 falls into an empty cradle 18 of feeder wheel 16. The rotation of the feeder wheel 16 causes a pre-determined, timed falling of the cradled insert 12 onto a feeding guide 20.

A driven cam 22 is rotatably secured to the apparatus 1. Cam 22 is connected to spring 50 which is attached to spring arm 52. The spring arm 52 has a bracket 54 which permits cantilever motion of lever 52. The bracket 54 engages, at one end, a wheel 56 which is in contact with cam 22, and at the other end, a rod 24. Rod 24 is positioned through a rod bracket 26 which is secured to the apparatus 1.

As cam 22 is driven, the rod 24 moves forwardly and moves or pushes the insert 12 slidably along the guide 20 through guide tube 58 and bore 26 which is horizontally disposed through the die head 10 (See FIG. 3). Tube 58 is in the same plane with bore 26 and is securded to die head 10 by nut 60. The insert 12 is driven a distance by rod 24 sufficient to cause it to engage the molten, extruded thermoplastic compound 3. The cam 22 and the feeder 16 are correspondingly time to continuously feed the next insert 12 into the tube 58 and bore 26 of die head 10.

Drive rollers 30 pull the chain of extruded, molten thermoplastic compound 3 through a pair of pinch rollers 32. Although pinch rollers 32 are disclosed in this preferred embodiment, any functionally similar electronic servo pinching means will suffice. The pinch rollers 32 rotate about their respective axes automatedly (not shown) in a timed correspondence with the feeding and introduction of inserts 12 through the die head bore 26. An initial engagement of the pinch rollers 32 with the thermoplastic compound 3 creates a squeezing of the side wall portions of the compound, thus, a seal 34, where compound 3 comes into physical contact with itself. The pinch rollers 32 are timed to correspond with the feeding and introduction of inserts 12 so as to avoid them during the sealing process. Seal 34, along the line of continous molten thermoplastic compound 3, forms the front end region of one container 36 and the back end region of the container 36 directly preceding it. A full rotation of the pinch rollers 32, after sealing the front end of container 36, then similarly seals the back end of the same container 36, again avoiding the insert 12. This resultant container 36 is completely sealed with an insert 12 encased therein. Drive rollers 30 pull the chain of containers 36 through a cooling water bath 38 setting the thermoplastic compound 3 in a solid state, and then to a die cutter 40 which separates each container 36 from the chain of containers 36.

In operation, a plurality of inserts 12 are placed in loader 14. Cradles 18 of feeder 16 each hold an insert 12. As the feeder 16 rotates, an insert 12 is dropped onto the feeder guide 20. As seen in FIGS. 2A–2E, gear driven cam 22 urges feeder rod 24 forwardly and against a to-be-guided insert 12 into the bore 26 of die head 10. The front of the insert 12 is caused to be engaged by the molten thermoplastic compound 3 and is pulled along the line by drive rollers 30. The thermoplastic compound 3 is sealed by pinch rollers 32 forming a sealed container 36 which is then cooled and cut into separate containers.

It is intended that the description of the preferred embodiments of this invention is illustrative only. Other embodiments of the invention that are within the scope and concept of this invention are herein included with this application.

What I claim is:

1. An apparatus suitable for continuous manufacture of filled extruded containers formed from extrudate, said apparatus comprising a material extruder connectable to a die head having a bore therethrough, a feeding means for introducing and placing an insert through the said die head bore and into said extrudate, a means for sealing said extrudate prior to solidification thereof forming a said container, and a cooling means to solidify the said container after sealing.

2. In the apparatus of claim 1, wherein said extruder material comprises a thermoplastic.

3. In the apparatus of claim 1, said feeding means further comprises an automatic timing means to position said insert within said extrudate and between said means for sealing.

4. In the apparatus of claim 1, said sealing means comprising pinching means for squeezing the said extrudate which forms adjacent containers while avoiding the said insert encased therein.

5. In the apparatus of claim 2, said feeding means further comprises an automatic timing means to position said insert within said extrudate and between said means for sealing.

6. In the apparatus of claim 2, said sealing means comprising pinching means for squeezing the said extrudate which forms adjacent containers while avoiding the said insert encased therein.

7. An apparatus suitable for continuous manufacture of filled extruded containers, said apparatus comprising a thermoplastic material extruder connectable to a die head having a bore disposed therethrough, a loader for holding separable inserts, a feeding means for placing said inserts in position for introduction through said bore, means for introducing said inserts through said bore such that said inserts, when introduced, engage molten thermoplastic material extruded through the said die head, means for sealing the said thermoplastic material to result in a continuous line of sealed containers such that the said sealing means avoids the said inserts encased therein.

8. In the apparatus of claim 7, said feeding means comprising a loader having a bottom, and housing a plurality of separate inserts, and a feeder wheel having grooves, said feeder wheel being located at the said bottom of said loader and being rotatable about its axis, said feeder wheel having cradles between said grooves such that a said insert can fit within a said cradle and be separately positioned onto a feeding guide upon the timed rotation of the said feeder wheel.

9. In the apparatus of claim 7, said sealing means comprising electronic servo pinching means for squeezing the side wall portions of the said thermoplastic material between adjacent containers while avoiding the said insert encased therein.

10. A method for continuously manufacturing filled extruded containers, comprising extruding a thermoplastic material through a die head having a bore disposed therethrough, loading separable inserts into a loader, feeding said inserts onto a feeding guide, introducing an insert through said bore such that a fed insert engages molten thermoplastic material extruded through the said die head, sealing the said material resulting in a continuous line of sealed containers such that the said sealing avoids the said inserts encased therein, and separating each of the sealed containers from the preceding and succeeding container.

* * * * *

UNITED STATES PATENT AND TRADEMARK OFFICE

CERTIFICATE OF CORRECTION

PATENT NO. : 5,471,821

DATED : Dec. 5, 1995

INVENTOR(S) : Lindgren, Peter B.

Figure 2A:
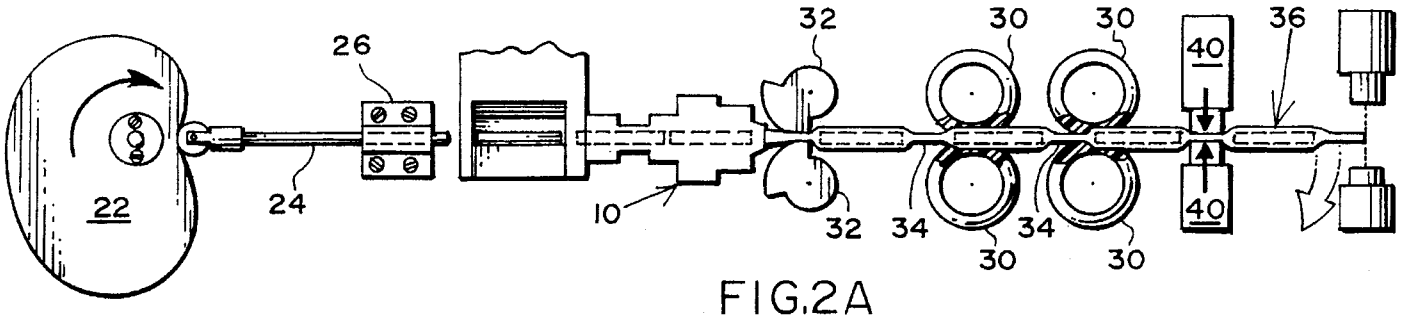
FIG. 2A–2E are diagrammatic side views of the various stages of operation of the present invention.
Figure 2B:
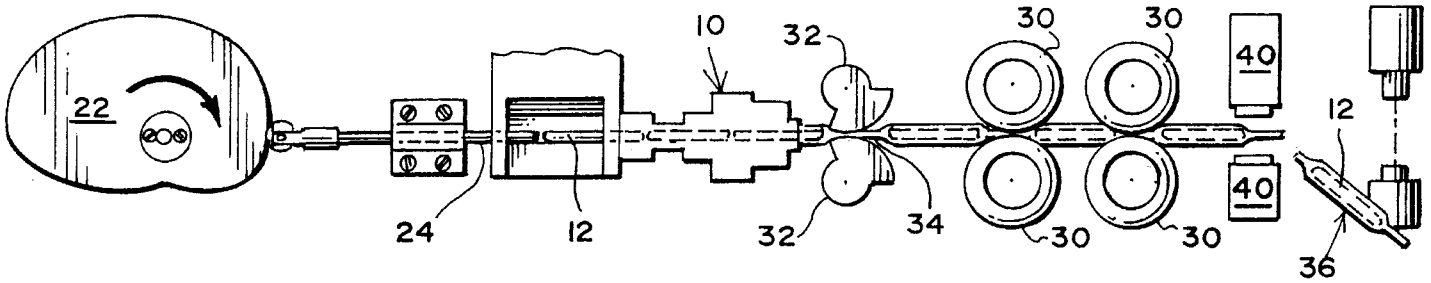
Figure 2C:
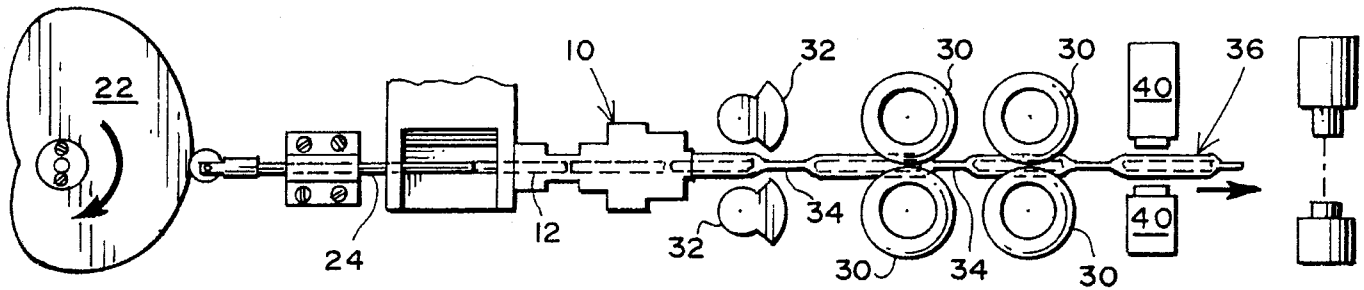
Figure 2D:
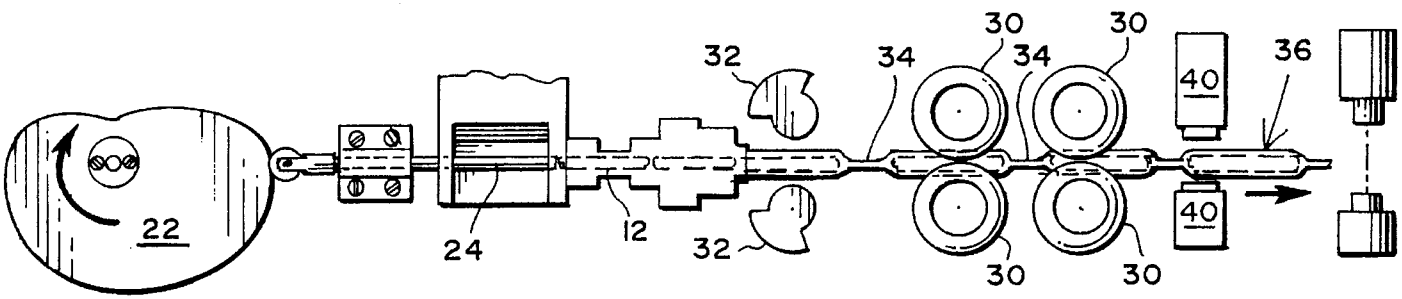
Figure 2E:
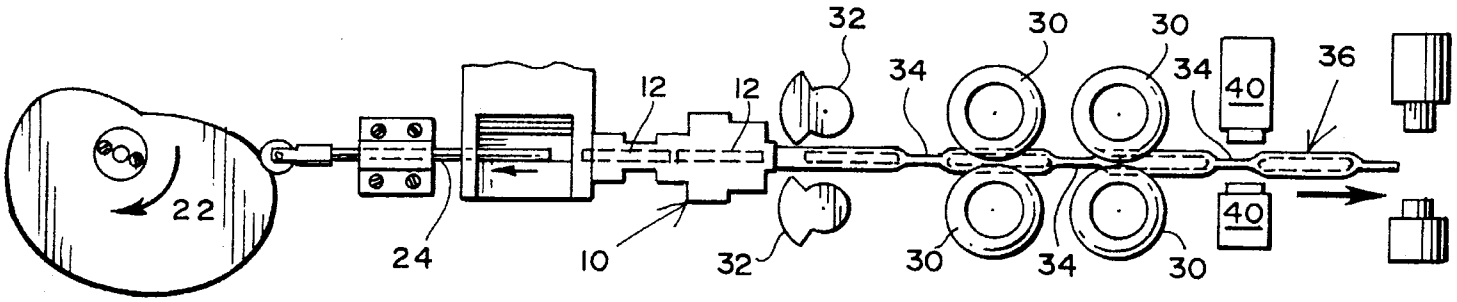

It is certified that error appears in the above-indentified patent and that said Letters Patent is hereby corrected as shown below:

In Col. 3, line 4, "lever" should be --spring arm--;
In Col. 3, lines 10, 12, 17, 25 and 48, reference numeral "26" should be --59--;

The sheet of drawing, consisting of fig. 2E and fig. 3 should be deleted to appear as per attached sheet.

Signed and Sealed this

Eighteenth Day of June, 1996

*Attest:*

Bruce Lehman

BRUCE LEHMAN

*Attesting Officer*

*Commissioner of Patents and Trademarks*